US006182378B1

(12) United States Patent
Sendaula

(10) Patent No.: US 6,182,378 B1
(45) Date of Patent: Feb. 6, 2001

(54) LOW PROFILE PNEUMATIC ELECTRIC GENERATOR INTEGRATED IN A MIDSOLE OF A SHOE

(75) Inventor: Musoke H. Sendaula, 10726 Wynstone Pl., Helotes, TX (US) 78023

(73) Assignee: Musoke H. Sendaula, Helotes, TX (US)

( * ) Notice: Under 35 U.S.C. 154(b), the term of this patent shall be extended for 0 days.

(21) Appl. No.: 09/095,364

(22) Filed: Jun. 10, 1998

(51) Int. Cl.[7] ..... A43B 23/00
(52) U.S. Cl. ..... 36/29; 36/136; 36/137
(58) Field of Search ..... 36/3 R, 29, 2.6, 36/3 B, 136, 137, 139; 219/211

(56) References Cited

U.S. PATENT DOCUMENTS

| | | | | |
|---|---|---|---|---|
| 4,674,199 | * | 6/1987 | Lakic | 36/2.6 |
| 4,678,922 | | 7/1987 | Leininger . | |
| 4,736,530 | * | 4/1988 | Lakic et al. | 36/2.6 |
| 4,782,602 | | 11/1988 | Lakic . | |
| 4,823,482 | * | 4/1989 | Lakic | 36/2.6 |
| 4,845,338 | | 7/1989 | Lakic . | |
| 5,167,082 | * | 12/1992 | Chen | 36/137 |
| 5,167,682 | | 12/1992 | Brookfield et al. . | |
| 5,367,788 | * | 11/1994 | Chen | 36/3 B |
| 5,483,759 | * | 1/1996 | Silverman | 36/137 |
| 5,495,682 | * | 3/1996 | Chen | 36/137 |
| 5,525,842 | | 6/1996 | Leininger . | |

OTHER PUBLICATIONS

Paper by Martyn Shorten in Biomechanics vol. 26, Sup 1 pp. 41–51 1993 is Attached.

* cited by examiner

*Primary Examiner*—M. D. Patterson

(57) ABSTRACT

This invention relates to a device for converting physiologically derived energy to electric energy while walking in a form a low profile pneumatic electric power generator that is adapted for integration in a midsole of a shoe, to generate power as the wearer walks. The pneumatic electric generator in one embodiment, comprise a stator in a form of a closed loop passageway with inlet ports for compressed air and outlet ports for the exhaust. The generator rotor consists of plurality of freely movable, mechanically unrestrained but magnetically coupled segments. The pneumatic generator is based on reciprocating air hammer action. Also a pneumatic oscillator, consisting of a shuttle valve, pinholes, and two air chambers of different volumes, which is used create a pulsating compressed airflow for the reciprocating air hammer action is described. In another embodiment, a low profile pneumatic electric generator stator is in a form of a long looped raceway with air inlets and outlets are located at both ends of the housing. A shuttle valve arrangement is used to control the opening and closing of the inlets and outlets at both ends of the looped raceway.

4 Claims, 13 Drawing Sheets

LOW PROFILE PNEUMATIC ELECTRIC GENERATOR INTEGRATED IN A MIDSOLE OF A SHOE

BACKGROUND OF THE INVENTION

1. Technical Field

A device for converting physiologically derived energy to electric energy while walking in a form of a low profile pneumatic electric power generator that is adapted for integration in a midsole of a shoe, to generate power as the wearer walks is disclosed. The midsole is also adapted to become a prime mover for the pneumatic electric generator, while doing its primary function of cushioning the foot. Thus, the present invention also relates to the design of a midsole of a shoe, specifically for the purpose of driving the pneumatic generator as well as cushioning the foot.

2. Prior Art

U.S. Pat. No. 3,857,7899 (1975) to Battle Development Corporation discloses a method and an apparatus for converting one form of energy into another form of energy. The method and apparatus uses a closed, continuous loop passageway containing a plurality of freely movable, mechanically unrestrained bodies which travel around the passageway in one direction only. Closed loop systems of this type, while are realizable, requires a mechanical flow control mechanism to ensure unidirectional motion. Unidirectional motion of the plurality of freely movable, mechanically unrestrained bodies does not seem to be key requirement for energy conversion.

The art of making of air hammers in well known. U.S. Pat. No. 3,894,586 (1975) to McDonnell Douglas Corporation disclosed a reciprocal air hammer in which the piston is driven in both directions. The unrestrained piston in the air hammer can be extended to a plurality of freely movable unrestrained bodies, moving back and forth in a closed passageway.

An air motor can be used to drive a conventional electric generator to generate electric power. Electric generators have been integrated in air tools, U.S. Pat. No. 5,525,842 (1996) to Volt-Aire Corporation, disclosed an improvement on an air motor having an integral generator, based on U.S. Pat. No. 4,678,922 (1987) to Leininger. In these patents the generation of electricity is to provide lighting to illuminate the work area while using the air tool. The electric generator is a part of the air tool rotor that is designed to develop the required torque for the operation of the tool. Magnets are inserted in the rotor and windings are set in the rotor housing to generate enough power for the light. This pneumatic electric generator is designed as a part of a tool driven by industrial type compressed air systems. While miniaturization of such a system is possible, it can not be easily integrated in applications with space constraints and operational conditions of a midsole of a shoe.

Integration of electric power generators into shoes has been proposed. For example, U.S. Pat. No. 4,782,602 (1988) and U.S. Pat. No. 4,845,338 (1989) both to Lakic, disclosed the design of a shoe with a foot warmer and an electric generator, driven by a coupling mechanism that translates the vertical movement of the heel to rotational motion. The power generated is only intended to warm the foot, and in a ski boot, the extra weight may not be a major problem. U.S. Pat., No. 5,167,682 (1992), and U.S. Pat. No. 5,495,682 (1996), to Chen disclosed the designs of "Dynamoelectric Shoes", with a pressure operated electric generator. The forces in the heel drive the generator through a set of levers and gears. These approaches do not utilize all the forces in the foot.

Martyn R. Shorten in Biomechanics Vol. 26, Supp. 1 pp 41–51, 1993, presented a detailed analysis of the energetics of running and running shoes and the midsole design objectives. The viscoelastic elements in the midsole are designed to dissipate the energy transferred into the midsole by the foot. In this approach the midsole is a shock absorber with a viscous dumper. The viscous damper is selected for its ability to dissipate the mechanical energy. In this invention the mechanical energy transferred into the midsole is harnessed and used instead of just dissipated. U.S. Pat. No. 5,224,278 (1993) to Jeon, is an example of a midsole with a shock absorbing airbags and viscoelastic elements to dissipate the energy.

In the development of the system to couple the mechanical energy in the foot during walking into the low profile pneumatic electric generator, it is necessary to use airbags with flow-check valves. The use of the flow-check valves with flappers is well established in inflatable products. There has not been a need to setup complex flow patterns in a midsole of a shoe, so the use of flow-check valves with airbags in midsoles has not been considered. Also the need to create pulsed-flows in a midsole of a shoe has not been realized.

The various approaches to integrating electric generators in shoes that have been attempted so far have not effectively collected most of the mechanical energy associated with the forces in the foot during walking. There are also excessive weight and reliability issues in some embodiments. Also there are problems associated with gyroscopic forces due to the spinning rotor. The goals for the design of shoe midsoles have been mainly to dissipate the mechanical energy. With the perforation of portable electronic devices, there is an obvious need to convert this energy into some usable form.

SUMMARY OF THE INVENTION

The first object of this invention is to provide a low profile pneumatic electric generator compatible with the weight, space and mechanical energy available in a midsole of a shoe without the use of gears and levers.

A second object of this invention is to adapt the low profile pneumatic electric generator for integration in a midsole of a shoe, to generate power as the wearer walks.

A third object of the invention is to design a midsole that couples most of the potential and kinetic energy transferred in the insole as one walks, jogs, and runs, into the pneumatic electric generator, while cushioning the foot.

A fourth object of this invention is to transform the mechanical energy transferred into the midsole so it can be used to power personal communication and computing systems, personal safety devices and other systems.

In accordance with these objects, low profile pneumatic electric generators adapted for integration into a midsole of a shoe are disclosed. In one embodiment, the pneumatic electric generator stator is in a form of a closed loop passageway with inlet ports for compressed air and outlet ports for the exhaust. Parts of the outer stator casing of the generators are made of ferromagnetic powder to provide a magnetic flux path, to cushion the foot and suppress noise and vibrations.

The generator rotor consists of plurality of freely movable, mechanically unrestrained segments. Unlike the air motor and a conventional electric generator combination, is fairly compact, since the compressed air is applied directly to the generator rotor. In this embodiment, these segments consist of permanent magnets so as to repel each other and hence provide a magnetic coupling between them. Some the forces needed for the reciprocating motion are due to the repulsion between the rotor segments. In another embodiment, the compressed airflow though a looped raceway is regulated so as to set up a reciprocating rotor.

The midsole is adapted to maximize the energy coupling between the foot and the pneumatic electric generator. It is designed to cushion the foot, to collect, and store mechanical energy. Most of the viscoelastic elements in the midsole are replaced with closed compressed air loops with flexible but inelastic air sacs acting as air compressors. Flow-check valves are arranged to set up unidirectional compressed airflow starting from the heel region to the forefoot and back to the heel region. A compressed air tank is used to store some of the mechanical energy and a pneumatic oscillator is used create a pulsating compressed airflow to drive the pneumatic generators.

| Reference Numbers in Drawings | |
|---|---|
| 10 basic low profile pneumatic generator | 12 generator housing |
| 14 generator inlet ports | 16 generator outlet ports |
| 18 generator power terminals | 20 generator passageway |
| 22 generator passageway lining | 24 generator rotor |
| 26 generator windings | 28 magnets in exciter |
| 30 pneumatic oscillator | 32 pneumatic oscillator inlet |
| 34 pneumatic oscillator outlets | 36 chamber in oscillator |
| 38 pinholes in oscillator | 40 chambers in oscillator |
| 42 shuttle valve in oscillator | 44 piston in shuttle valve |
| 46 airbags in shuttle valve | 48 generator with oscillator |
| 50 compressed air tank | 52 exhaust air chamber |
| 54 heel air compressor | 56 forefoot air compressor |
| 58 flow-check valve | 60 liquid pads |
| 62 flow-check valve | 64 noise suppression pads |
| 66 flow-check valve | 68 flow-check valve |
| 70 shuttle valve | 72 piston in shuttle valve |
| 76 hole in piston | 78 another generator |
| 80 looped raceway | 82 magnetic yoke |
| 84 air sacs in looped raceway | 86 spherical magnets |
| 88 nonmagnetic spheres | |

DETAILED DESCRIPTION OF THE INVENTION

Figure 1A:
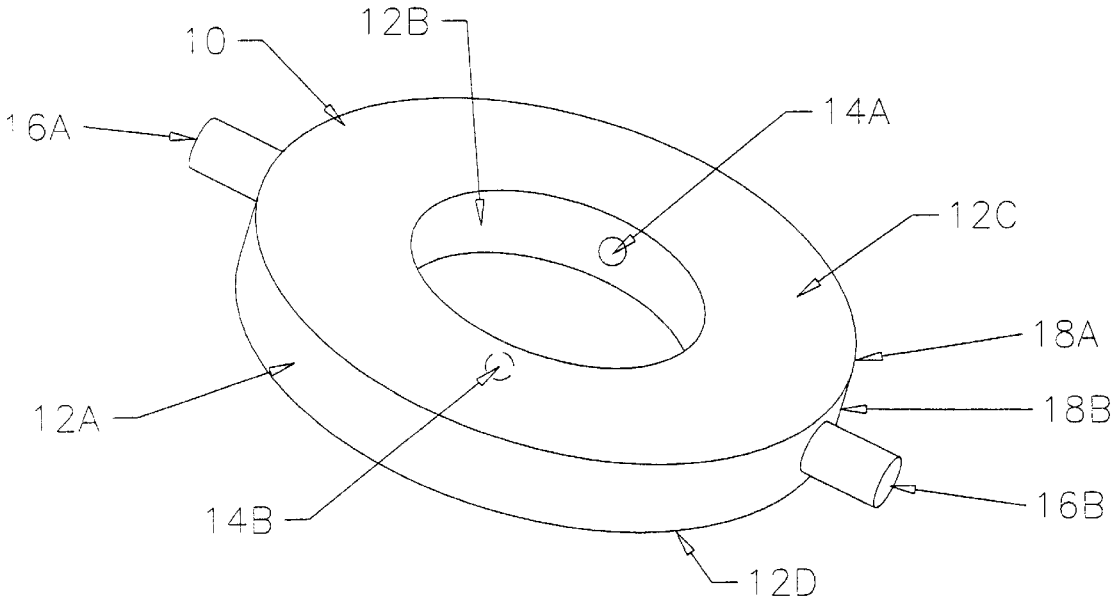
FIG. 1A shows a three-dimensional view of one of the embodiments of a low profile pneumatic electric generator.
Figure 1B:
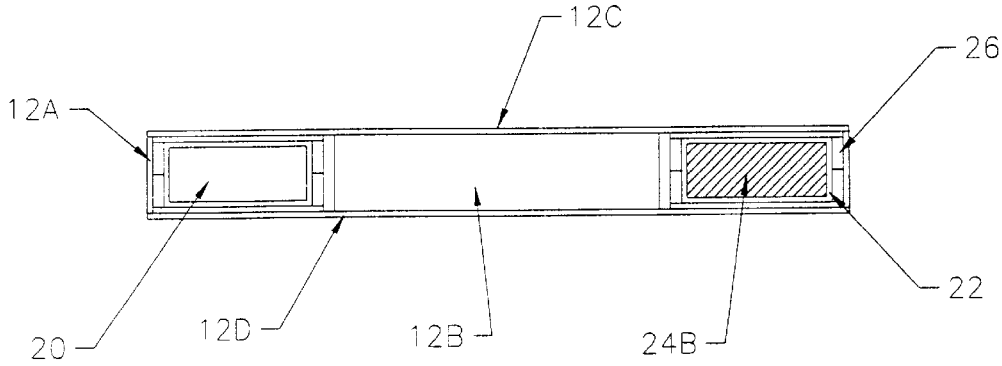
FIG. 1B shows a cross-sectional view of the pneumatic electric generators in FIG. 1A.

An embodiment of a low profile pneumatic electric generator is shown in FIG. 1. A three-dimensional view of this embodiment is shown in FIG. 1A, and a cross sectional view is shown in FIG. 1B. In this embodiment of the pneumatic electric generator 10 housing is in a form of a thick washer with an outer cylindrical part of the housing 12A and an inner cylindrical part of the housing 12B. Top and bottom plates 12C and 12D complete the housing, which also form the generator stator outer housing. Ports 14A and 14B, are inlet ports for the compressed air that drives the pneumatic generator, and ports 16A and 16B are the exhaust air outlet ports. Terminals 18A and 18B are the electric power output ports. Parts of the outer stator housing 12A, 12B, 12C and 12D are made of ferromagnetic powder encapsulated in flexible but inelastic membranes, under high magnetic fields, to provide a magnetic flux path, to cushion the foot, and to suppress noise and vibrations.

Referring specifically to FIG. 1B, the shape of the cross section of the closed loop passageway 20 in this embodiment is rectangular; it could be elliptical or any other shape as long as the height is minimized. The passageway 20 has a lining 22, which is Teflon coated to minimize friction between the lining and rotor segments. The rotor segment 24, which may also be Teflon coated, is sized to fit into the passageway with just enough room to take into account of the thermal expansion. Windings 26 are deployed around the passageways or on the top and the bottom of the passageway, depending on the orientation of the magnetic poles in the rotor segments. In this embodiment, the magnetic poles are such that the windings will be at the top and bottom of the passageway.

Figure 2A:
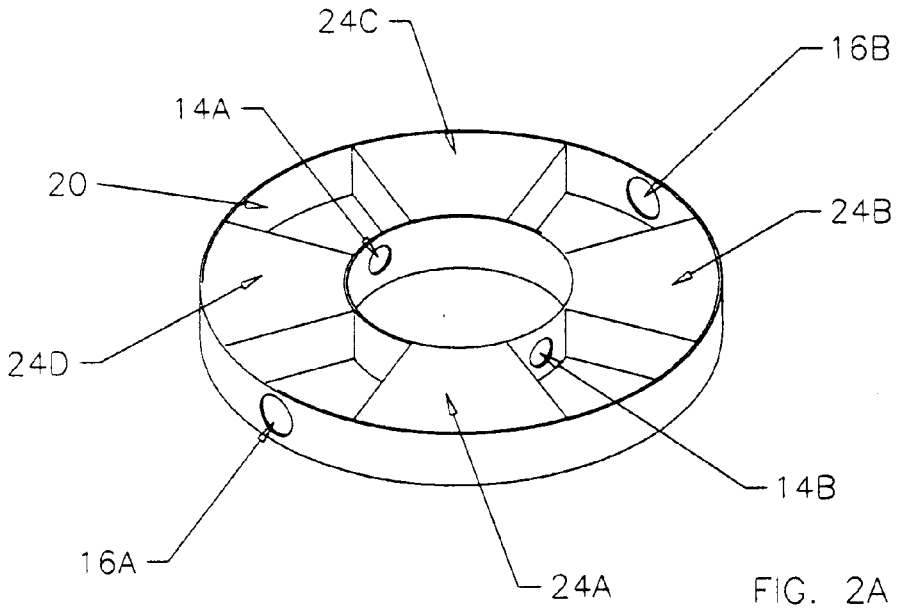
FIG. 2A shows details of the rotor segments in a closed passageway for the pneumatic generator in FIG. 1.

FIG. 2A shows details of the rotor segments in a closed passageway for the pneumatic generator in FIG. 1. A set of windings 26 is arranged on top and at the bottom of the inner lining of the passageway. The inner lining also has inlet port 14A and 14B and outlet ports 16A and 16B. Four magnets 24A, 24B, 24C, and 24D constituting the segmented rotor are shown in passageway 22.

Figure 2B:
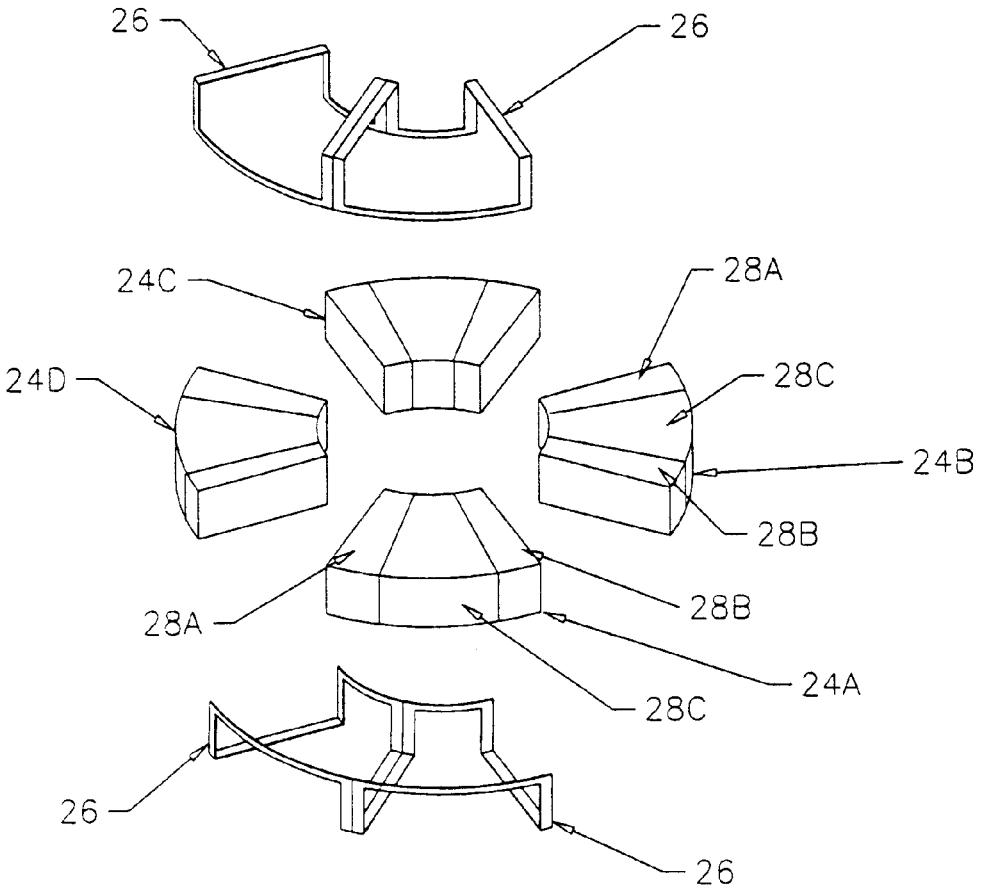
FIG. 2B shows the permanent magnet exciters in relation to the windings in the stator for the generator in FIG. 1.

FIG. 2B shows a three-dimensional view of the windings 26 both at the top and at the bottom in relation to the permanent magnet rotor segment 24. In this embodiment, the permanent magnet rotor segment 24 comprises of three magnet sections 28A, 28B, and 28C. The magnetic poles of sections 28A and 28B for any two rotor segments are oriented so the two segments repel each other. This arrangement ensures that the rotor segments are evenly distributed in the closed loop passageway. The orientation of the magnetic pole of section 28C is to ensure maximum change in the flux through the windings as the rotor segments move up and down the closed loop passageway. The windings are interconnected appropriately to achieve the desired voltage and current levels and are eventually connected to the power terminals 18A and 18B.

Figure 3A:
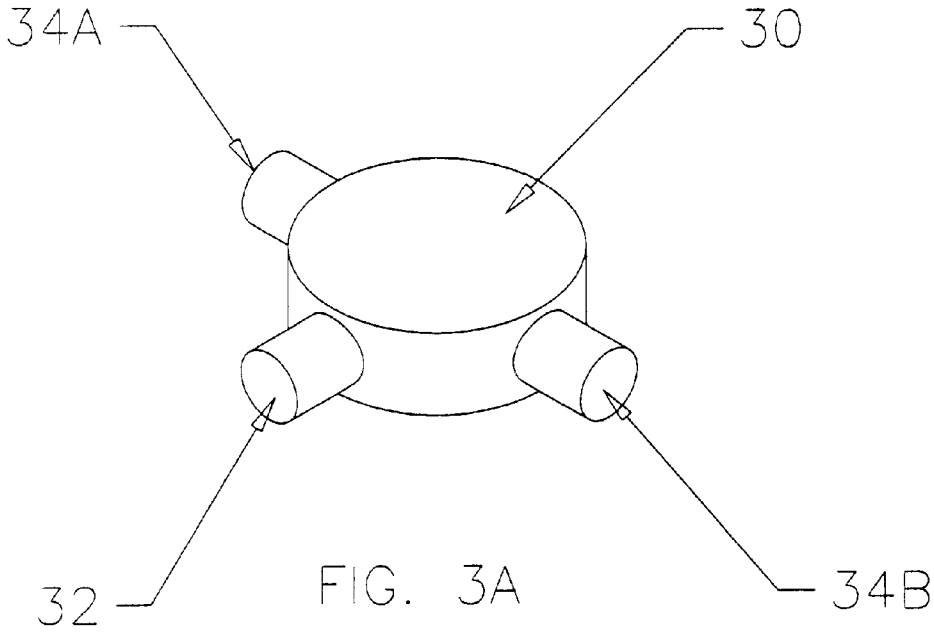
FIG. 3A is a three-dimensional view of an embodiment of a pneumatic oscillator that creates a two-phase pulsating compressed airflow.

Unlike the method and apparatus for converting one form of energy into another form of energy disclosed in the U.S. Pat. No. 3,857,7899 (1975) to Battle Development Corporation, an apparatus for generating power in this patent is based on the reciprocating air hammer concept. Pneumatic oscillator 30, consisting of a shuttle valve, pinholes, and two air chambers of different volumes is used create a pulsating compressed airflow for the reciprocating air hammer action. FIG. 3A is a three-dimensional view of an embodiment of a pneumatic oscillator 30 that creates a two-phase pulsating compressed airflow. The pneumatic oscillator converts the incoming compressed airflow through the inlet port 32 into two pulsating flows through outlet ports 34A and 34B.

Figure 3B:
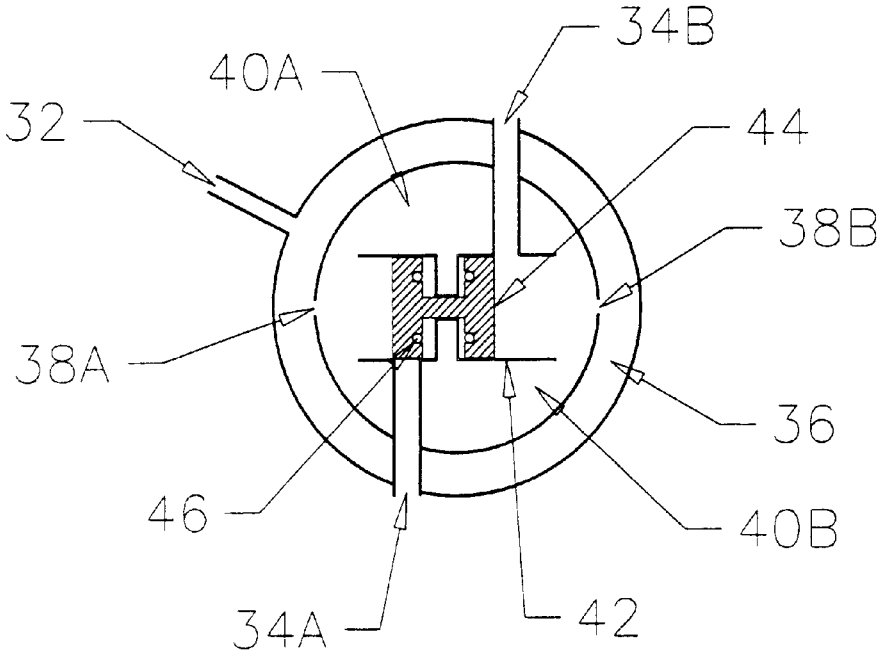
FIG. 3B is the cross-sectional view of the pneumatic oscillator that creates a two-phase pulsating compressed airflow in FIG. 3A.

FIG. 3B is the cross-sectional view of a pneumatic oscillator in FIG. 3A that creates a two-phase pulsating compressed airflow. Referring specifically to FIG. 3B, compressed air enters an outer chamber 36 through an inlet port 32 and then proceeds to flow through pinholes 38A and 38B, into inner chambers 40A and 40B, respectively. The volumes of chambers 40A and 40B are slightly different, so that the rate at which the pressure rises in chambers 40A and 40B will be different. Pressures in chambers 40A and 40B control the position of shuttle valve 42 and hence the opening and closing outlet ports 34A and 34B. Assuming that both chambers 40A and 40B, are initially empty and one of the outlet ports is closed. After some time, the pressure in of the chambers with the closed outlet port will get high enough to operate the shuttle valve 42. The pressure in the chamber, which has been closed, will eventually close the outlet port, which has been open while opening the outlet port of that chamber. Flow through the corresponding outlet port 34A or port 34B will effect the pressure decay and buildup in chamber 40A and 40B. Eventually the pressure in the chamber with the open outlet port will decay, while the pressure in the chamber with the closed outlet port will increase. Eventually, the pressure in the chamber, which has been closed, will eventually close the outlet port, which has been open while opening the outlet port of that chamber. The cycle will repeat as long as there is incoming compressed air. Pistons 44 and the inner walls of the shuttle valve 42 is Teflon coated to minimize friction. Small airbags 46 are integrated in to cushion piston 44 as it hits the stops in shuttle valve 42.

Figure 4A:
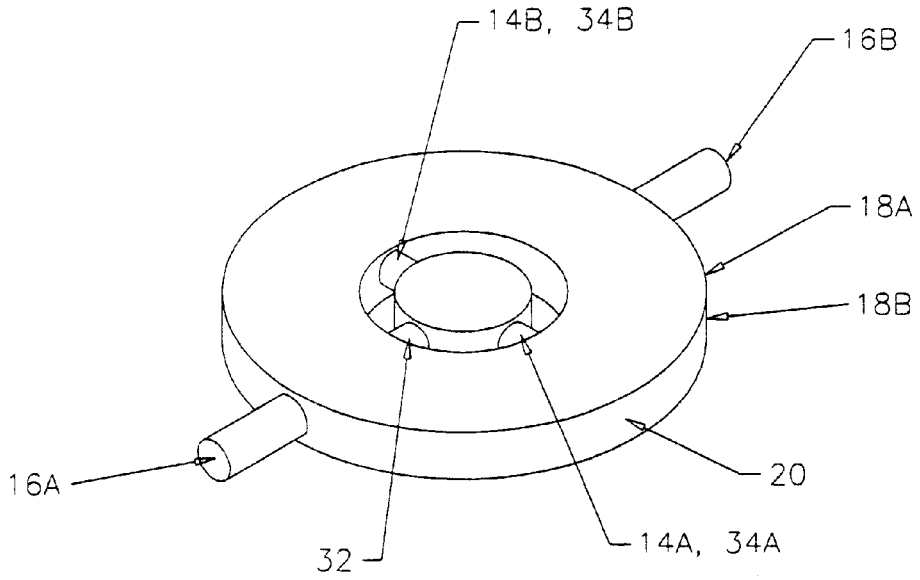
FIG. 4A shows a three-dimensional view of one of the embodiments of pneumatic electric generator connected to a pneumatic oscillator.

FIG. 4A shows a three-dimensional view of an embodiment of pneumatic electric generator connected a pneumatic oscillator that creates a two-phase pulsating compressed airflow. Compressed air enters the pneumatic oscillator 30 through inlet port 32 and pulsating compressed air will enter closed loop passageway 20 through inlet ports 14A or 14B through the pneumatic oscillator outlet ports 34A and 34B, respectively. Exhaust air will leave the closed loop passageway 20 through outlet ports 16A and 16B.

Figure 4B:
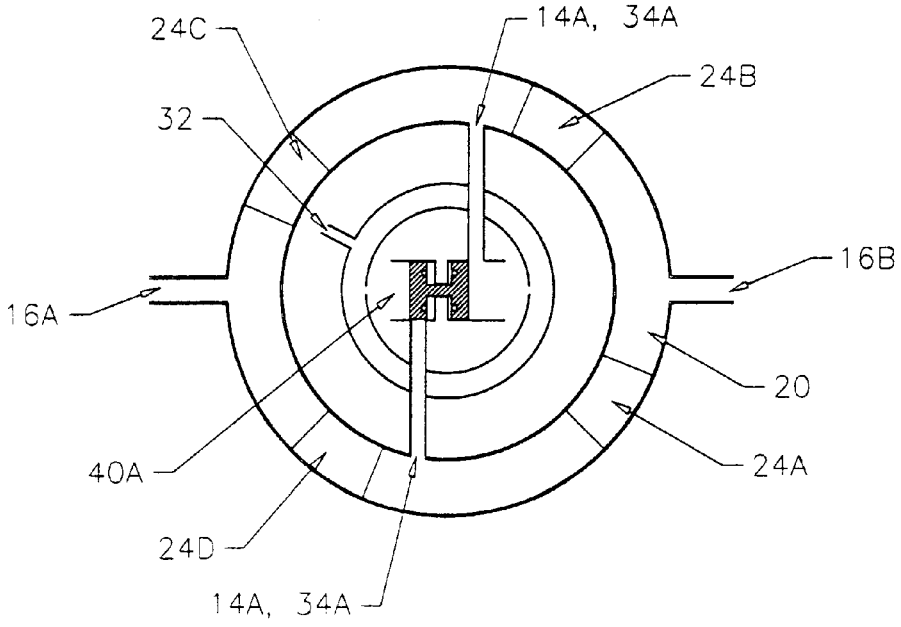
FIG. 4B is a cross-sectional view of pneumatic electric generator connected to a pneumatic oscillator without the windings and the generator outer housing for the generator in FIG. 4A.

FIG. 4B is a cross-sectional view of pneumatic electric generator connected to a pneumatic oscillator without the windings and the generator outer housing. In this embodiment, the segmented rotor dynamics depends on the mechanical forces due to the compressed air, and the magnetic forces. In the case shown, the rotor segments consists of four compound magnets 24A, 24B, 24C, and 24D. The pressure in chamber 40B is high, so compressed air through port 14B will drive the rotor segments 24B and 24C towards outlet ports 16A and 16B, respectively. Rotor segments 24A and 24B will be repelled by the magnetic forces of the approaching rotor segments and will be driven towards port 14A and closer together. When the rotor segments 24A and 24B go beyond the exhaust ports 16A and 16B, respectively, provided the pressure at outlet ports 16A and 16B is low, the pressure in chamber 40B will collapse. Then shuttle valve 42 will close outlet 34B and open outlet 34A. The combination of the repulsive magnetic forces between the rotor segments, and the forces due to compressed air from inlet port 14A will slow down the rotor segments and eventually drive them in the opposite direction. Thus the low profile pneumatic electric generator rotor segments dynamics is similar to that of a reciprocating air hammer, with magnetic forces assisting in the return.

With a proper choice of magnets and closed loop passageway length, the repulsive magnetic forces can be high enough to provide the needed restoring force for the reciprocating motion. In that case a single-phase pneumatic oscillator, consisting of one outlet port, one chamber, with shuttle valve piston with unequal areas, can be used to drive the rotor segments.

Figure 5A:
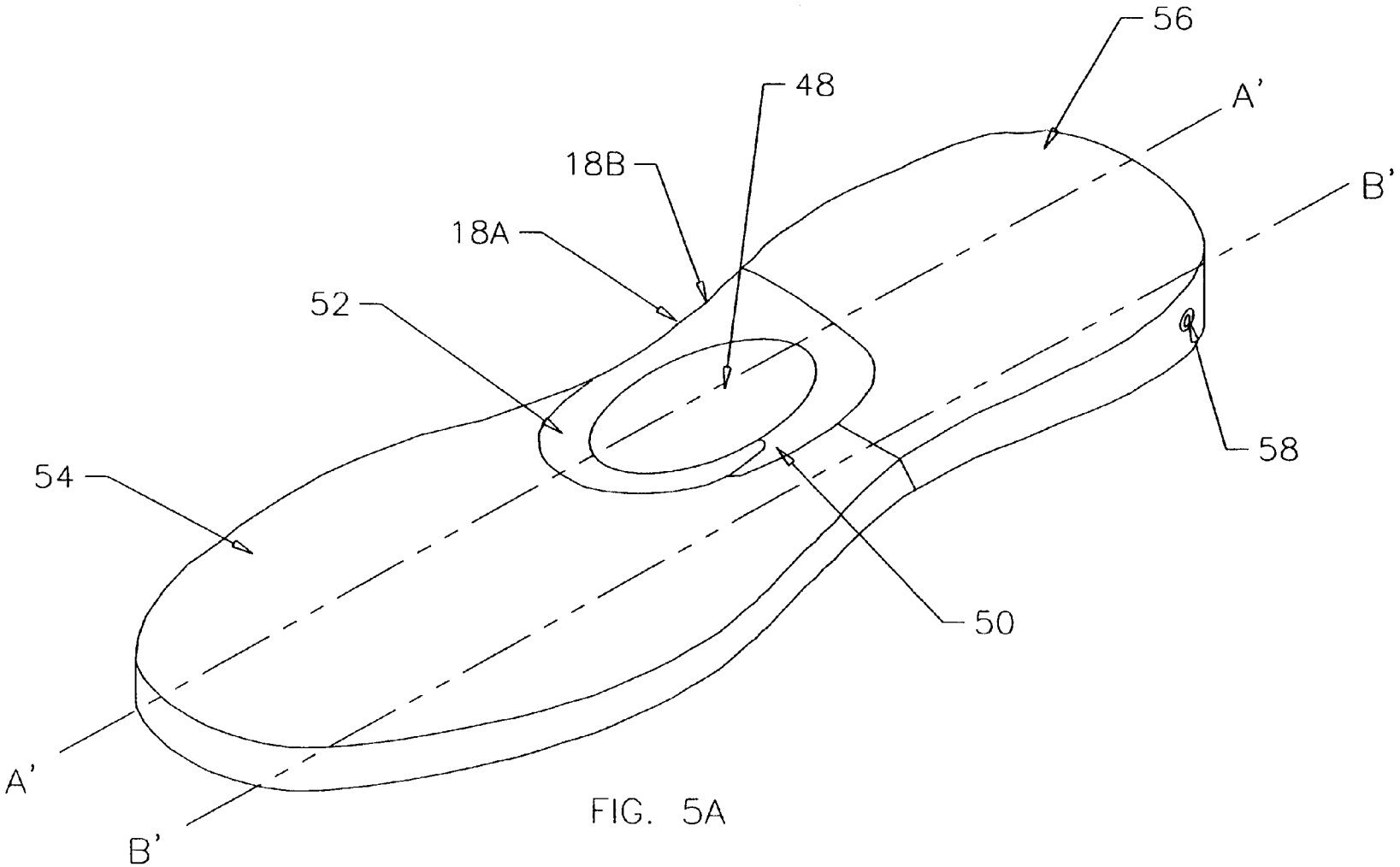
FIG. 5A shows a three-dimensional view of an embodiment of pneumatic electric generator in FIG. 4 integrated in a midsole of a shoe.

FIG. 5A shows a three-dimensional view of an embodiment of a low profile pneumatic electric generator integrated into a midsole of a shoe. The pneumatic electric generator and pneumatic oscillator with additional cover form one unit 48, which is surrounded by a compressed air tank 50 and an exhaust air chamber 52. The midsole is adapted to cushion the foot, and to collect and store mechanical energy. Flexible but inelastic air sacs 54 and 56 form air compressors that collect mechanical energy. Air compressor 54 has a flow-check valve 58 for refilling the air sacs. The embodiment of a low profile pneumatic electric generator integrated into a midsole in FIG. 5A could be made as an insole that can be inserted in a shoe.

Figure 5B:
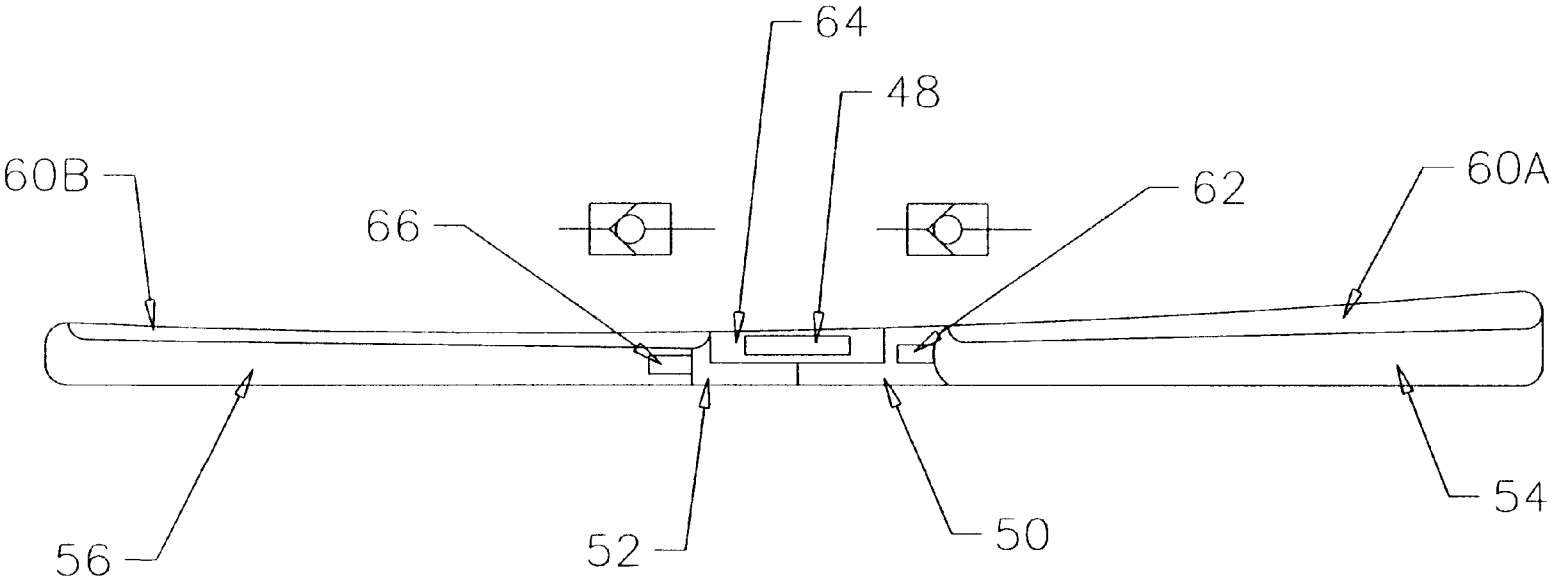
FIG. 5B shows cross sectional view of an embodiment of pneumatic electric generator in FIG. 5A along AA'.

FIG. 5B shows cross sectional view of an embodiment of pneumatic electric generator integrated in a midsole of a shoe along AA'. Liquid or gel filled pads 60A and 60B are integrated into the top layers of the air compressors to act as a liquid piston for the compressor and to provide cushioning in case most of the air is forced out of the compressor chambers. The heel air sac or compressor 54 is connected through flow-check valve 62 to a compressed air tank 50. The compressed air tank 50 and the exhaust air chamber 52 together with the protection and noise suppression pads 64 provide support and protection to the generator unit 48. Noise suppression pads 64 are made of appropriate materials that minimize noise and vibrations. The exhaust air chamber 52 is connected to the forefoot air sac or compressor 56 through flow-check valve 66.

Figure 5C:
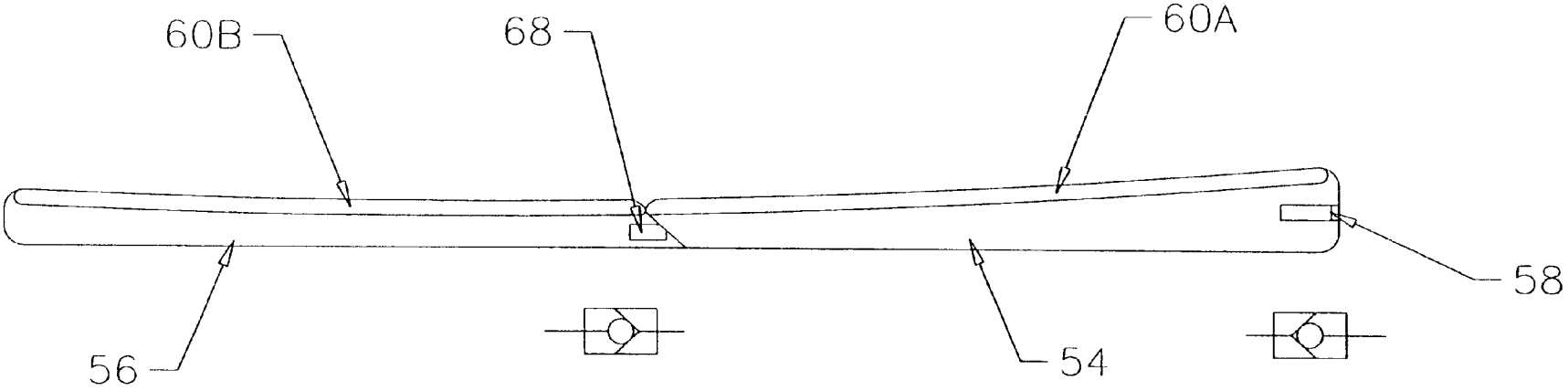
FIG. 5C shows cross sectional view of an embodiment of pneumatic electric generator in 5A along BB'.

A cross-sectional of a view of an embodiment of pneumatic electric generator integrated in a midsole along BB' in FIG. 5A is shown in FIG. 5C. The forefoot air sac or compressor 56 is connected to the heel air sac or compressor 54 through flow-control valve 68. Flow-check valves 62, 66, and 68 are all oriented to form a unidirectional airflow loop.

Figure 5D:
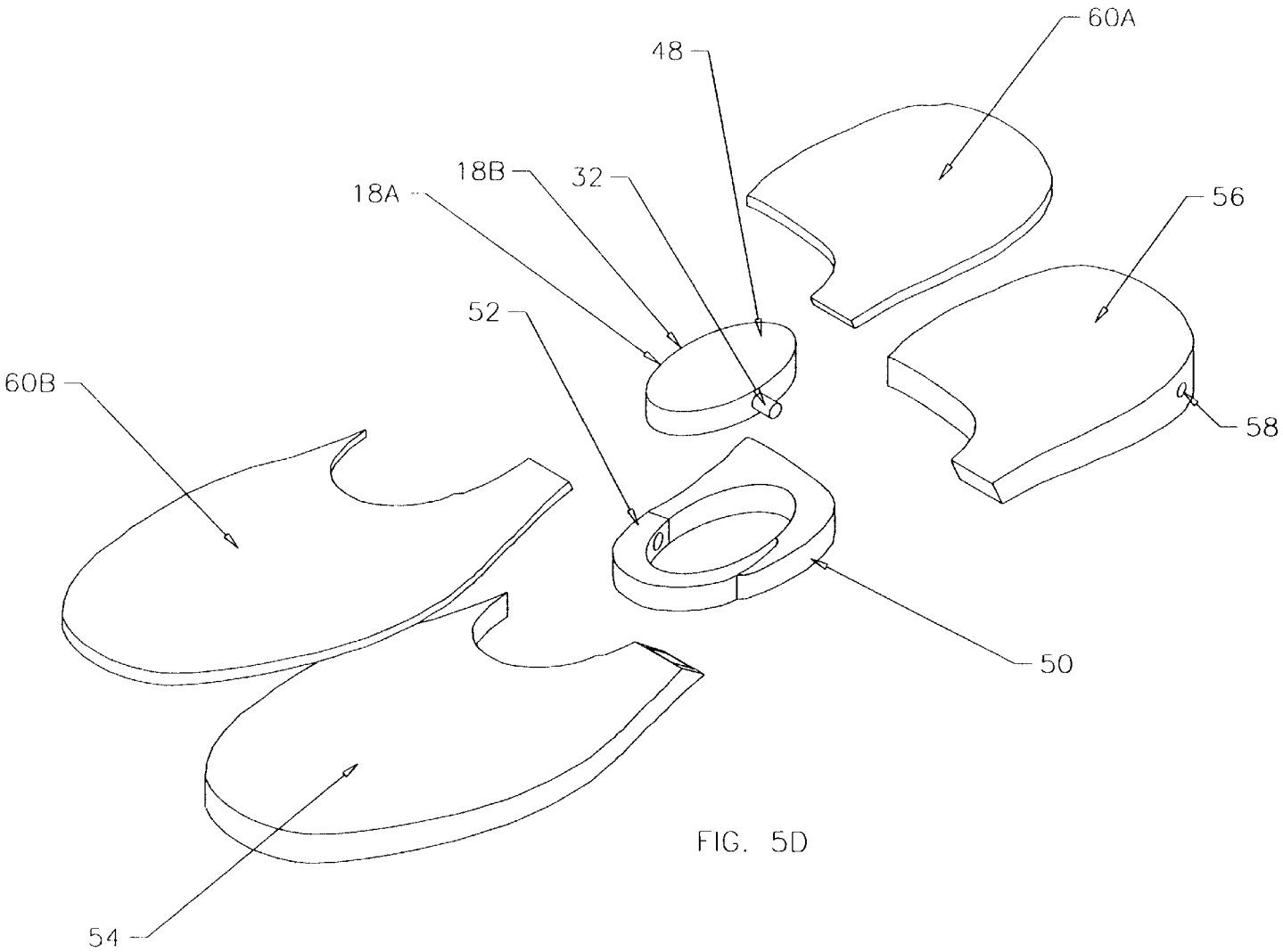
FIG. 5D is an exploded view of an embodiment of pneumatic electric generator in FIG. 5A integrated in a midsole of a shoe.

FIG. 5D is an exploded view of an embodiment of pneumatic electric generator integrated in a midsole of a shoe. It gives the spatial relationships between the different subsystems with the associated plumbing. Liquid or gel filled pads 60A and 60B form the top layers of air sacs or compressors 54 and 56. The generator unit 48 is secured by the compressed air tank 50 and exhaust air chamber 52.

Figure 6A:
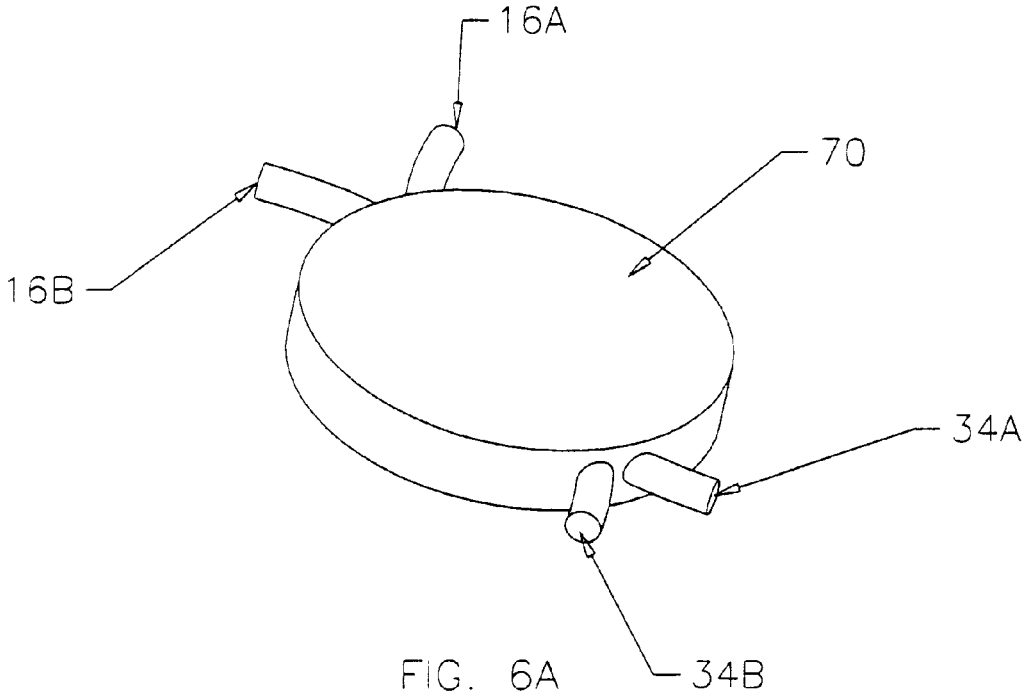
FIG. 6A is a three-dimensional view of a possible implementation of a shuttle valve that controls the flow through a pair of lines depending on the pressure in both lines.
Figure 6B:
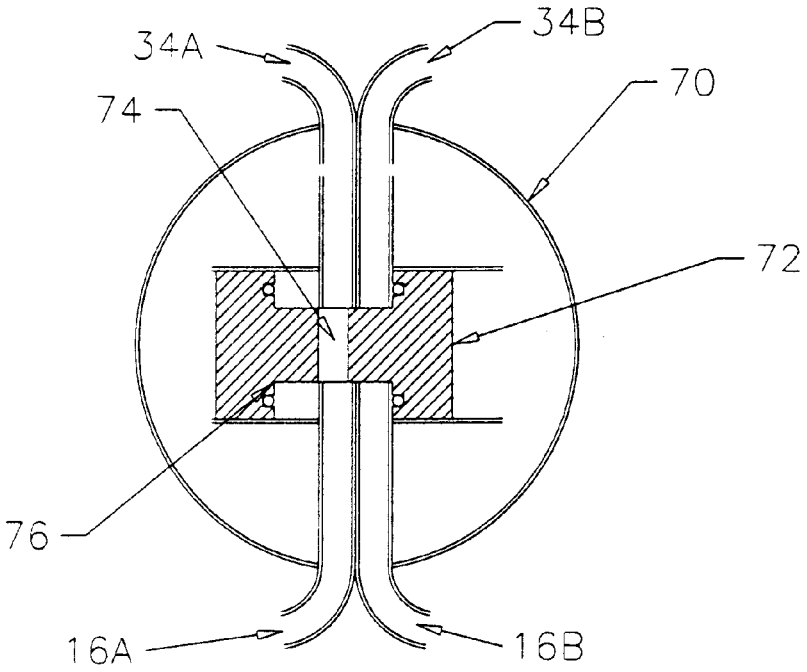
FIG. 6B is a cross sectional view of a possible implementation of a shuttle valve that controls the flow through a pair of lines depending on the pressure in both lines.

The embodiment of the low profile electric generator in FIG. 1 relies on the magnetic forces to ensure that all the rotor segments are evenly distributed in the closed loop passageway 20, which limits the length of the passageway. In some cases it may be advantageous to have a long looped raceway. Compressed air from one of the phases of a pulsating flow would drive the rotor segments to the end of the looped raceway and the other phase of the pulsating flow would drive the rotor segments back. In this case, the compressed air inlets and outlets are located at both ends of the loop. A switching arrangement is needed to dynamically configure one end as an inlet while the other end becomes an outlet. FIG. 6A shows a three-dimensional view of a possible implementation of a shuttle valve 70 that controls the flow through outlet 16A and 16B depending on the pressure in inlets 34A and 34B. FIG. 6B is a cross sectional view of a possible implementation of a shuttle valve in FIG. 6A. Shuttle valve 70 has to have the low profile compatible with the pneumatic electric generator otherwise it consists of piston 72 with opening 74 such that if the pressure in 34A is higher that in 34B, outlet port 16B is open. If the pressure in 34B is higher that in 34A, outlet port 16A is open. Air sacs 76 are imbedded in piston 72 to minimize the impact of the piston with the stops.

Figure 7A:
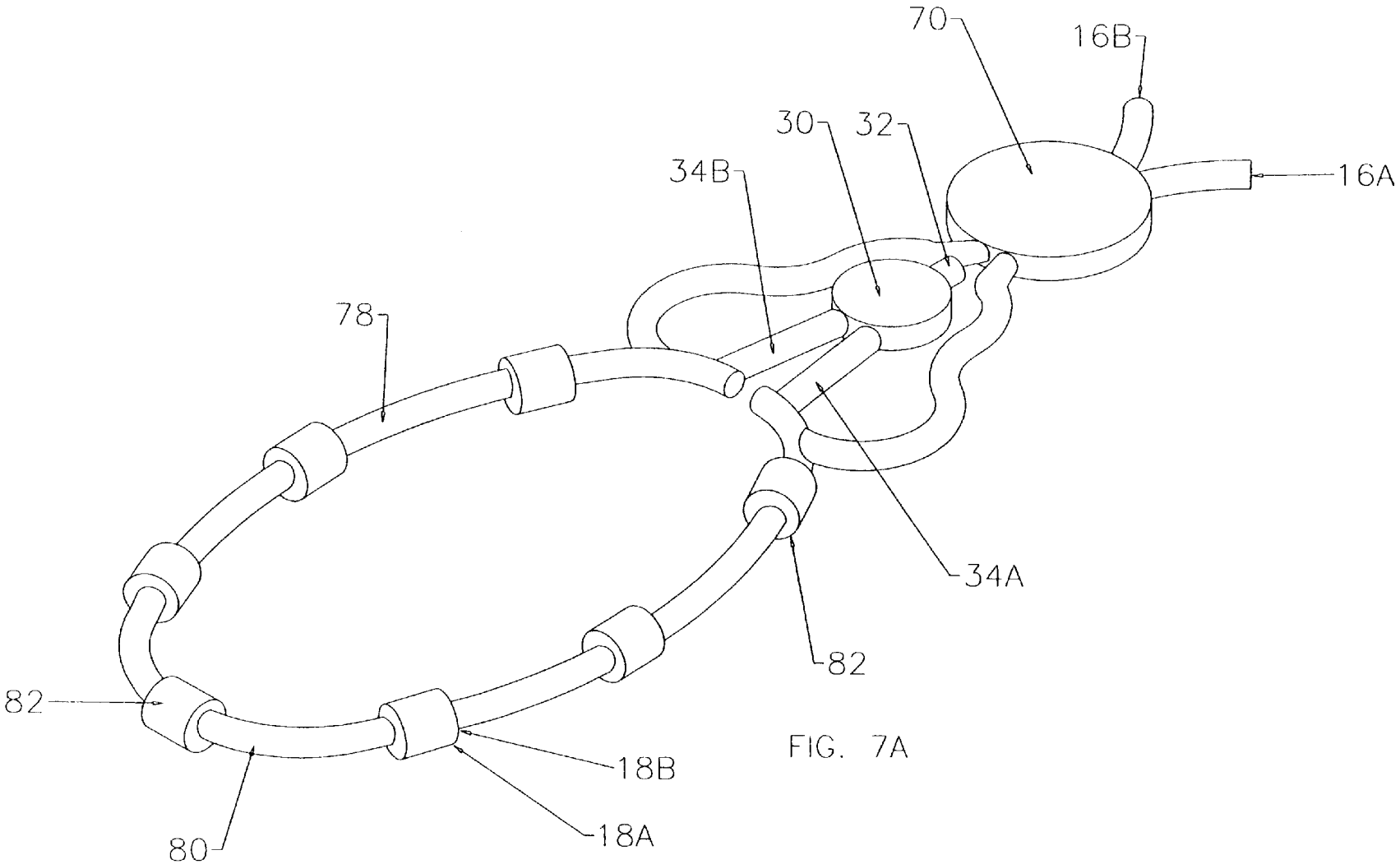
FIG. 7A is a three dimensional view of another embodiment of a low profile pneumatic electric generator with looped raceway.

FIG. 7A is a three dimensional view of another embodiment of a low profile pneumatic electric generator with looped raceway. In this embodiment, the electric generator 78 raceway 80 is a looped tube with both ends closed. Two-phase pulsating flow from pneumatic oscillator 30 drives the generator with exhaust air through outlet ports 16A and 16B controlled by directional shuttle valve 70. A set of windings and magnetic yokes segments 82 are appropriately positioned around raceway 80.

Figure 7B:
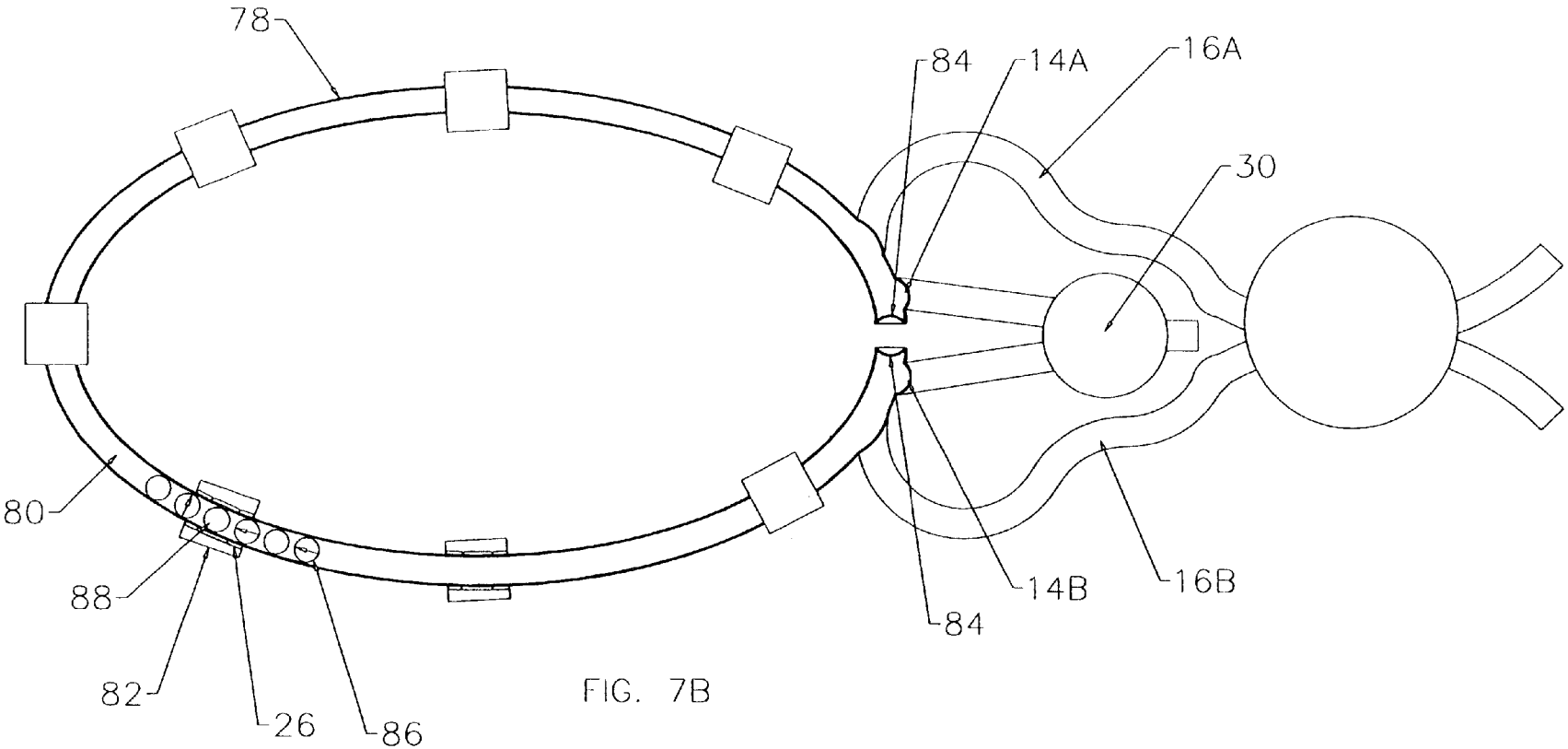
FIG. 7B is a cross sectional view of another embodiment of a low profile pneumatic electric generator with looped raceway.

FIG. 7B is cross sectional view of a pneumatic generator with a looped raceway in FIG. 7A. It shows the location of inlet ports 14A and 14B in relation to outlet ports 16A and 16B. Air sacs 84 are built in the plugs at each end of the looped raceway to minimize the impact of the rotor segments piston with the plugs. Winding and magnetic yoke segment 82 is similar to a section in the embodiment in FIG. 1 with the curvature adjustment for the tubular raceway. The windings and magnetic yokes segments 82 are separated to provide sections in which the rotor segments will be accelerating before encountering the next segment. In this embodiment the tubular looped raceway is assumed to have a circular cross section. In this case the rotor segments could consist of magnets 86 encased in spherical magnetically permeable shells separated by nonmagnetic spheres 88. Although the orientation of the magnets 86 in spherical shells will vary, as the magnet enters the winding and magnetic yoke segment, it will tend to orient itself appropriately with respect with respect to windings 26 to minimize the reluctance. Other means of excitation are possible, for example, if two windings are used, as shown in FIG. 2A, one of the windings could be provide the excitation, and the rotor segments could include ferromagnetic spheres, magnetic spheres, appropriately separated by nonmagnetic spheres.

Figure 8:
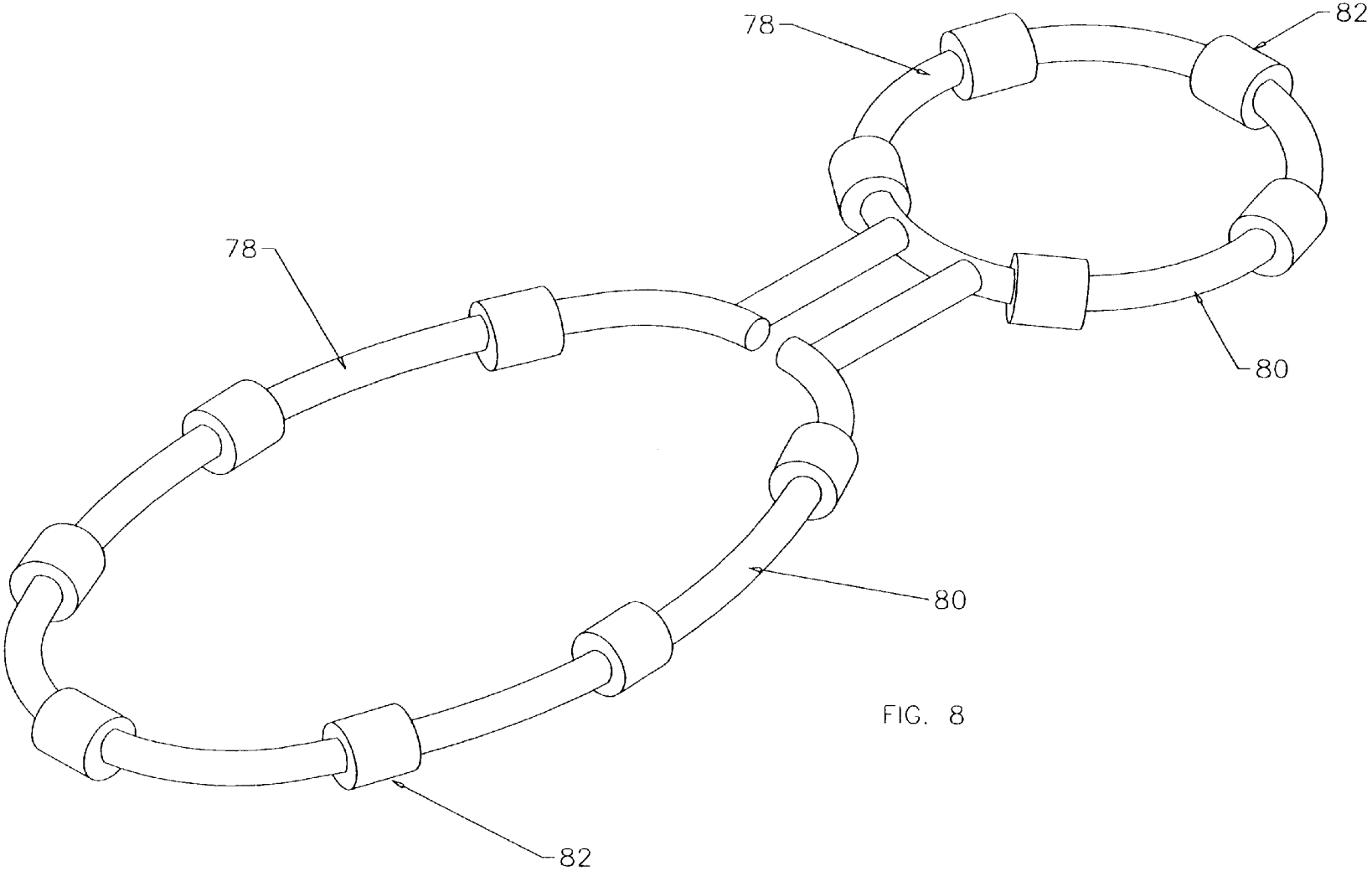
FIG. 8 shows two generators with looped raceways configured for integrated in a midsole of a shoe.

FIG. 8 shows two generators with looped raceways integrated in a midsole of a shoe. The looped raceway of each of is generator 78 is sized so that the generator housing tubular structure will be on the peripheral of the midsole. With this configuration, the air sacs or air compressors can be designed to fill up the rest of the space in the midsole, without appreciably impacting the traditional shape of the midsole.

Figure 9:
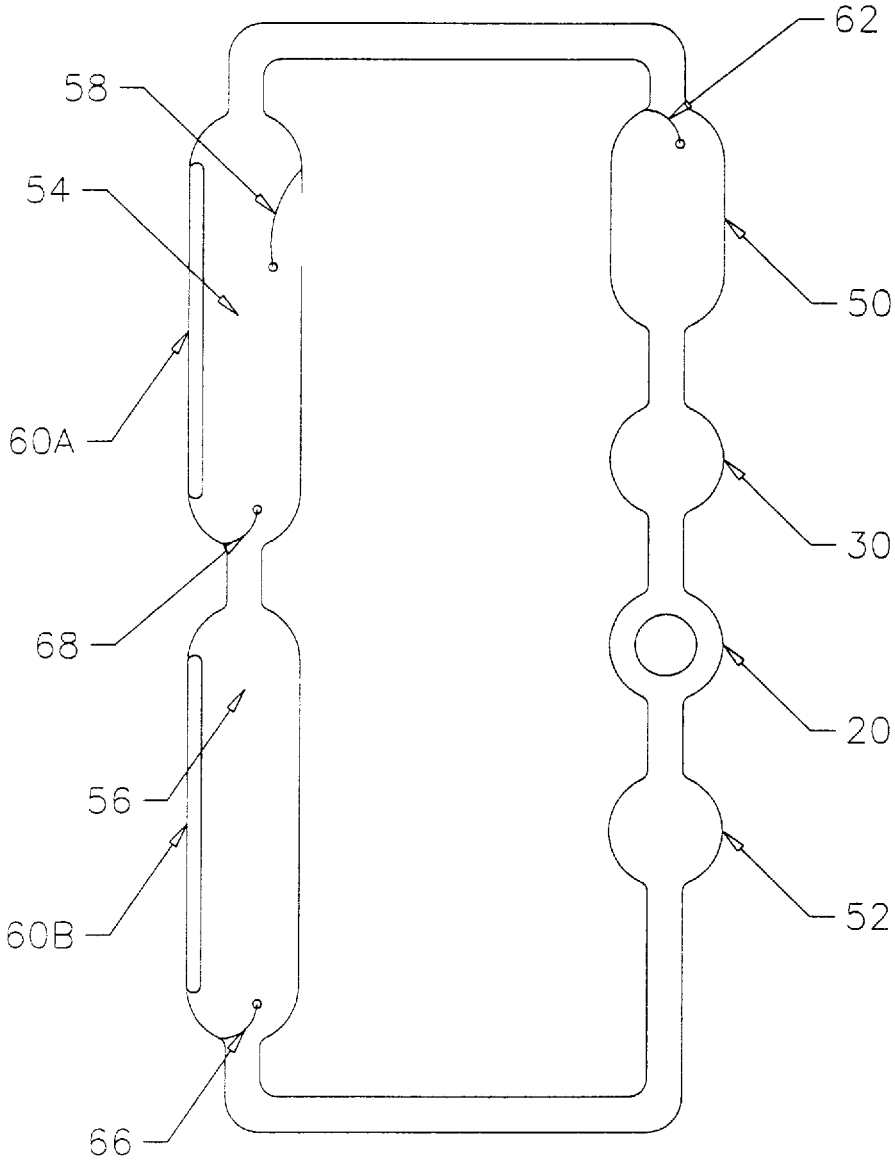
FIG. 9 shows the functional operations of low profile pneumatic electric generators integrated in a midsole of a shoe.

FIG. 9 shows the functional operations of low profile of pneumatic electric generators in FIG. 4 integrated in a midsole of a shoe. The closed pneumatic loop includes flow-check valves 62, only allows compressed air only to flow through the pneumatic oscillator 30 and the and then through the closed passageway 20. On exiting the generator passageway 20 exhaust air returns to air sac or compressor 56 through flow-check valve 66 and then through flow-check valve 68 to the heel air sac or compressor 54 which is connected to flow-check valve 62. The pneumatic loop for the pneumatic generator with a looped raceway in FIG. 7 is very similar to that of the pneumatic generator in FIG. 4. The only difference is the addition of shuttle valve 70 to control the flow into exhaust air chamber 52.

Operation

Referring specifically to FIG. 9, the operation of a pneumatic electric generator during walking starts at heel down. The pressure applied to the midsole in the heel region compresses the air in air sac 54 and forces it through flow-check valve 62 into the compressed air tank 50. Compressed air from tank 50 drives pneumatic oscillator 30, which in turn drive the generator rotor segments. On exiting the generator closed loop passageway 20, airflow into the forefoot air sac 56 through flow-check valve 66. As long as the pressure in the heel region remains high, the pressure in heel air sac 54 will much higher than that in the forefoot air sac 56. As the forces in the foot shift towards the midfoot, the pressure in the heel region will decrease thus allowing air to flow from the forefoot air sac 56 through flow-check valve 68 back into the heel air sac 54. As pressure increases in the forefoot region, more air is forced back into the heel air sac and some into the compressed air tank. The volumes of the compressed air tank and the flow rates between the tank and the pneumatic oscillator, and that between the pneumatic oscillator and the generator are selected such that the there is enough compressed air in the tank to drive the generator until the next heel down.

The dynamics of the overall electromechanical energy conversion system is governed by a system of coupled differential equations. Qualitatively, the system has various response modes. The conversion of mechanical energy into electrical energy will be maximized at the resonant frequency of the overall system. The selection of the electrical and pneumatic subsystems components values will based on the desired operating modes of the overall system.

Conclusions and Scope

Two embodiments of low profile pneumatic electric generators adapted for integration into a midsole of a shoe are disclosed. The pneumatic electric generator in one embodiment, comprise a stator in a form of a closed loop passageway with inlet ports for compressed air and outlet ports for the exhaust. The generator rotor consists of plurality of freely movable, mechanically unrestrained segments but magnetically coupled. The pneumatic generator is based on reciprocating air hammer action. Stator windings are appropriately arranged to maximize the coupling of the flux due to the permanent magnets in the rotor segments and the windings. Also a pneumatic oscillator, consisting of a shuttle valve, pinholes, and two air chambers of different volumes, which is used create a pulsating compressed airflow for the reciprocating air hammer action is described.

The magnetic poles of the rotor segment are arranged so that there is a repulsive force between the rotor segments. Thus the rotor segments are couple by a form of magnetic spring, which cause the segments to spring back after a compressive force is removed. The rotor segments dynamics is this generator embodiment is similar to that of a reciprocating air hammer, with magnets providing all or some of the return forces.

In another embodiment, a low profile pneumatic electric generator with a long looped raceway is described. The generator housing tubular structure and it can be made a long as necessary, since compressed air inlets and outlets are located at both ends of the housing. A shuttle valve arrangement is used to control the opening and closing of the inlets and outlets at both ends of the looped raceway. Parts of the outer stator housing of the generators are made of ferromagnetic powder to provide a magnetic flux path, to cushion the part of the foot that may come in contact with the generator, and suppress noise and vibrations.

A midsole designed to maximize the energy coupling between the foot and the pneumatic electric generator disclosed. Flexible but inelastic air sacs, with liquid or gel filled pads, on top are used as air compressors. The flow-check valves are arranged to set up unidirectional compressed airflows starting from the heel region at heel down. As the forces in the foot shift from the heel region to the midfoot, air is forced back into the heel region through the generator. The advantages of the disclosed method and apparatus include the following:

- a design of pneumatic electric generator, with high energy density, which can be integrated in a midsole of a shoe, without the use of gears and levers;
- a low profile pneumatic electric generator with a long looped raceway, whose size can be easily adjusted;
- a midsole as an energy collector that takes into account the temporal and spatial force distributions in the foot during walking.

The embodiments in this invention have focused on the design of low profile electric generator and it integration in a midsole of a shoe. The pneumatic oscillator could be used to improve the operations of conventional air hammers. The pneumatic generator based on a reciprocating air hammer can be integrated in air tools, for applications similar to those considered in U.S. Pat. No. 5,525,842 (1996) to Volt-Aire Corporation. It is therefore understood that the present invention can be practiced otherwise than as specifically described herein and still will be with in the spirit of the following claims.

What is claimed is:

1. A midsole of a shoe adapted for converting mechanical energy due to the foot forces while walking to electrical energy, comprising:

a low profile pneumatic electric generator;

a system of air sacs driven by the foot during walking, said air sacs fluidly connected to the generator to provide compressed air to drive the low profile pneumatic electric generator.

2. A midsole as claimed in claim 1 further comprising liquid filled pads located on top of the air sacs, which act as liquid pistons, to compress air that drive the pneumatic generator while cushioning the foot.

3. A midsole as claimed in claim 2 wherein said air sacs are in the form of pneumatic loops flow-check valves located in said pneumatic loops to form an unidirectional airflow;

a compressed air tank for storing energy transferred into the midsole while walking.

4. A midsole as claimed in claim 1, wherein the low profile pneumatic electric generator comprises:

a stator in a form of at least one closed passageway made out of nonmagnetic material with input and output compressed air ports and stator windings around the passageway;

a rotor comprising of a plurality of segments, mechanically unrestrained but magnetically coupled;

said rotor segments are an even number of permanent magnets, which also form the generator exciter, with magnetic poles oriented so that the magnetic force between any pair of rotor segments is repulsive to keep the rotor segments evenly distributed in the passageway;

said rotor segments driven by compressed air, move as air hammer pistons in the closed passageway, with the rotor segments driven by a combination of pneumatic and the repulsive magnetic forces;

a magnetic circuit that couples the flux created by the permanent magnets in the said rotor segments to the stator windings that are deployed around the passageway.

* * * * *